US010195510B2

(12) United States Patent
Simone

(10) Patent No.: US 10,195,510 B2
(45) Date of Patent: Feb. 5, 2019

(54) SLIDING T-SQUARE PRACTICE AID

(71) Applicant: KARSTEN MANUFACTURING CORPORATION, Phoenix, AZ (US)

(72) Inventor: Matthew W. Simone, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 15/682,243

(22) Filed: Aug. 21, 2017

(65) Prior Publication Data

US 2018/0056164 A1 Mar. 1, 2018

Related U.S. Application Data

(60) Provisional application No. 62/378,333, filed on Aug. 23, 2016.

(51) Int. Cl.
*A63B 69/36* (2006.01)
*A63B 102/32* (2015.01)

(52) U.S. Cl.
CPC ..... *A63B 69/3667* (2013.01); *A63B 69/3658* (2013.01); *A63B 2102/32* (2015.10); *A63B 2225/09* (2013.01)

(58) Field of Classification Search
USPC ..... 473/273, 409
See application file for complete search history.

(56) References Cited

U.S. PATENT DOCUMENTS 3,610,632 A 10/1971 Caldwell
3,635,396 A * 1/1972 Palfi ..... G06G 1/04 235/70 R
4,257,608 A * 3/1981 Funk ..... A63B 69/3667 473/272
4,354,683 A 10/1982 Woolland
4,563,010 A * 1/1986 McDorman ..... A63B 24/0003 473/267
5,435,727 A 7/1995 Dobson
5,549,298 A 8/1996 Cullen et al.
5,588,653 A 12/1996 Robinson
5,951,409 A 9/1999 Calley
6,077,168 A * 6/2000 Huang ..... A63B 69/3667 473/218
6,669,575 B1 12/2003 Marlette
(Continued)

OTHER PUBLICATIONS

"Tru Align Alignment Sticks Training Aid", Source: http://www.golftrainingaids.com/Tru-Align-Golf-System/productinfo/TRUALIGN/, Date Accessed: Jan. 21, 2016.

*Primary Examiner* — Nini Legesse

(57) ABSTRACT

A golf alignment aid comprising: a first bracket including a first portion, a second portion adjacent to the first portion, and a third portion adjacent to the second portion; the second portion including a first channel and a second channel oriented parallel with the first channel, and a third channel configured to receive a first alignment stick, and a second bracket including a first rail slidably received within the first channel, a second rail oriented parallel with the first rail and slidably received within the second channel, and a cradle positioned between the first rail and the second rail; the cradle configured to receive a second alignment stick oriented perpendicular to the first alignment stick.

14 Claims, 8 Drawing Sheets

(56) References Cited

U.S. PATENT DOCUMENTS

| | | | | |
|---|---|---|---|---|
| 6,726,576 | B1 | 4/2004 | Froggatte | |
| 7,607,987 | B2 | 10/2009 | Alter | |
| 7,927,227 | B2 | 4/2011 | Carpenter | |
| 9,126,092 | B2 * | 9/2015 | Deacon ..... | A63B 69/3641 |
| 2015/0011323 | A1 | 1/2015 | Downing | |

* cited by examiner

SLIDING T-SQUARE PRACTICE AID

CROSS-REFERENCE TO RELATED APPLICATIONS

This claims the benefit of U.S. Provisional Patent Application No. 62/378,333, filed on Aug. 23, 2016, which is incorporated fully herein by reference.

FIELD OF INVENTION

The present disclosure relates to a golf practice aid. In particular, the present disclosure is related to a golf practice aid for consistent foot and body placement while striking the ball.

BACKGROUND

A consistent swing of the golf club provides a better opportunity for a golfer to score lower. Practice aids of various sorts are available to develop a more consistent golf swing. Some aspects of a consistent swing include ball position relative to foot position, ball distance from the golfer's body, and alignment of the golfer's feet and shoulders relative to the desired ball flight path. One practice aid in common use are alignment sticks. Alignment sticks are light rods laid upon the ground with one crossed over the other in parallel for flight determination or in a perpendicular arrangement to allow the golfer to consistently position themselves as they practice with various clubs.

A golfer practicing with a club that typically takes a divot when striking the ball is constantly moving backwards or forwards to find an unused portion of turf upon which to place the ball for each new shot. With a pair of crossed alignment sticks, the cross rod indicating ball position must be moved backwards or forwards to point to an unused portion of turf. In the current art, this movement requires the golfer to bend over and move the cross rod, or try to move it with their club. Moving the cross rod with a club often misaligns the intersection of the two rods or is inaccurate. This delays the golfer in their practice or degrades the efficacy of the alignment aid.

There is a need in the art for a golf practice aid that allows the golfer to keep the alignment sticks in the proper relative positions while also allowing easy movement of the alignment stick that indicates the ball position.

Figure 1A:
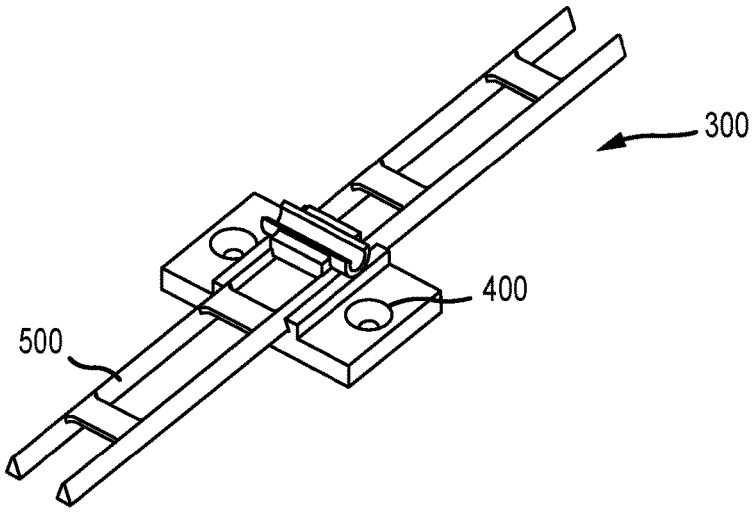
FIG. 1A is a perspective view of a golf alignment aid according to an embodiment of the present invention.

Other aspects of the disclosure will become apparent by consideration of the detailed description and accompanying drawings.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures are not necessarily drawn to scale. For example, the dimensions of some of the elements in the figures may be exaggerated relative to other elements to help improve understanding of embodiments of the present disclosure. The same reference numerals in different figures denote the same elements.

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein.

DETAILED DESCRIPTION

The golf aid disclosed here is a two part bracket system intended in one embodiment for use with a pair of alignment sticks. The bottom bracket is intended to be secured to the playing surface and to perform at least two functions. First, it is intended to hold a first alignment stick in a position parallel to the desired ball flight. Second, it is intended to provide a base for sliding the top bracket back and forth along that parallel line. The top bracket is also configured to perform at least two functions. First, it is intended to hold a second alignment stick perpendicular to the first alignment stick while the second alignment stick is also indicating the ball position for the next practice stroke. Second, it is intended to slide back and forth in channels on the bottom bracket to allow the golfer to adjust the position of the second alignment stick with a tap of their golf club and without requiring the golfer to bend over and manually adjust the position of the second alignment stick with their hand.

The invention disclosed herein is a golf alignment aid comprising a first bracket including a first portion, a second portion adjacent to the first portion, and a third portion adjacent to the second portion, the second portion may include a first channel and a second channel oriented parallel with the first channel, and a third channel configured to receive a first alignment stick, and a second bracket including a first rail slidably received within the first channel, a second rail oriented parallel with the first rail and slidably received within the second channel and a cradle positioned between the first rail and the second rail. The cradle can be configured to receive a second alignment stick oriented perpendicular to the first alignment stick. The first channel of the golf alignment aid has a first cross sectional area and the second channel has a second cross sectional area. The first cross sectional area of the first channel may be the same as the second cross sectional area of the second channel. The first portion of the first bracket of the golf alignment aid has a first width, and the second portion of the first bracket has a second width. The third portion of the first bracket has a third width. In the preferred embodiment, the widths of the first, second and third portions of the first bracket are the same. In another embodiment, the width of the second portion of the first bracket may be larger than the widths of the first and second portions of the first bracket. The first bracket may be configured to be attached to the ground. In one embodiment, the first portion and the third portion may have apertures configured to receive a pin, such as a golf tee, to secure the bracket to the ground. In another embodiment, the first bracket may have pointed protrusions or spikes that can be pushed into the ground.

The first length of the first rail of the second bracket may be the same as the second length of the second rail. The cradle may be semi-circular in cross-sectional area. The cradle defines a longitudinal axis and the longitudinal axis of the cradle can be oriented perpendicular to the first rail and to the second rail. The second bracket may have contact features for the golfer to move the second bracket slidably in either direction across the first bracket. The features may be rectangular blocks along the longitudinal axis of the cradle which may be used as golf club contact blocks. A club contact block may be on at least each long side of the cradle. The golfer may use their golf club to slide the second bracket relative to the first bracket by pushing on either club contact block.

Referring to FIG. 1A illustrates a golf alignment aid 300 according to a preferred embodiment of the present invention. The golf alignment aid 300 includes a first bracket 400 and a second bracket 500 that slides relative to the first bracket 400. This arrangement allows the golfer to maintain the alignment sticks in a perpendicular arrangement while also allowing the golfer to quickly and easily adjust the position of the second bracket 500 with a golf club while standing.

Figure 1B:
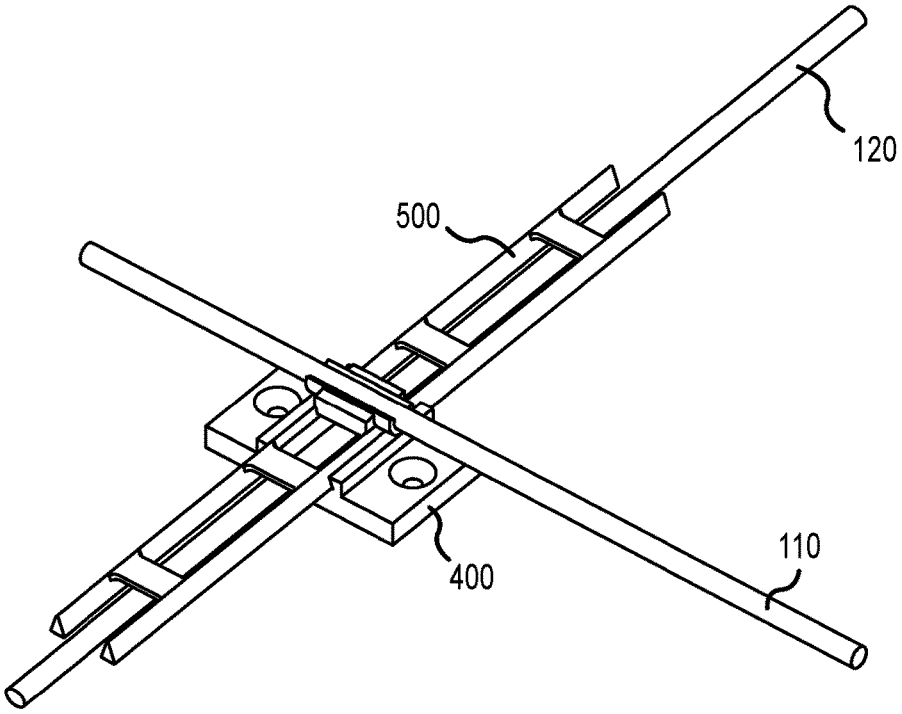
FIG. 1B is a top perspective view of the golf alignment aid with alignment sticks in place.
Figure 5:
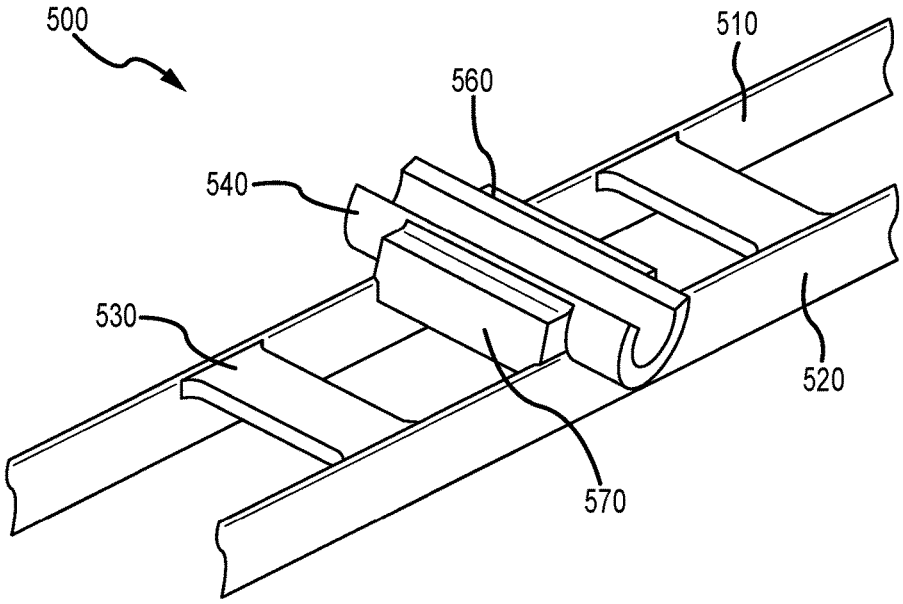
FIG. 5 is a top perspective view of a second bracket of the golf alignment aid illustrated in FIG. 1.

The golf alignment aid 300, shown with alignment rods in FIG. 1B, may accomplish two major functions: 1) The brackets 400, 500 hold the two alignment sticks 110 and 120 oriented perpendicular to each other. Alignment stick 110 is used by the golfer to indicate the desired direction of the ball flight. Alignment stick 120 is used by the golfer to indicate the position of the ball. 2) As illustrated in FIG. 5, the second bracket may also provide convenient club contact structures in the blocks 560 and 570, which allow the golfer to slide the second bracket 500 relative to the first bracket 400 without having to bend over and use his/her hands. Together these features provide functionality and an ease of use that is not available in the art.

FIG. 1B shows an angled perspective that illustrates the golf alignment aid 300 with alignment stick 120 placed into the first bracket 400 and alignment stick 110 placed into the second bracket 500. The first or bottom bracket 400 is preferably anchored to the playing surface as shown in the illustrated embodiment by pushing golf tees through the provided apertures into the turf. This first or bottom bracket 400 has a first alignment stick 120 inserted into a provided channel to hold it in a position parallel to the desired ball flight direction. The second or top bracket 500 is illustrated with a second alignment stick 110 placed into a cradle perpendicular to the first alignment stick. This second bracket 500 is configured in this embodiment with two rails sliding in two channels configured in the top of the first bracket. This arrangement allows the second or top bracket 500 to move back and forth while being held in a desirable, perpendicular position to the first or bottom bracket 400. In turn, the second alignment stick 110 in the cradle of the second or top bracket 500 is kept perpendicular to the bottom, first alignment stick 120.

Figure 1C:
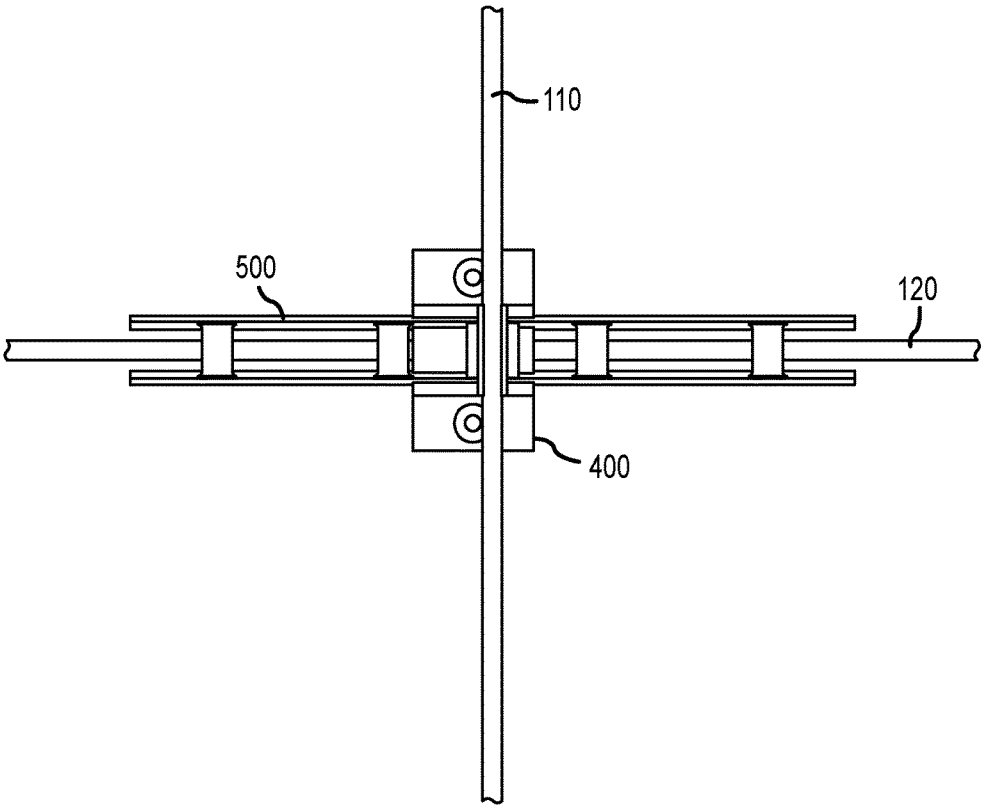
FIG. 1C is a top view of the golf alignment aid with alignment sticks in place.

FIG. 1C illustrates the golf alignment aid 300 with alignment stick 120 placed into the first bracket 400 and alignment stick 110 placed into the second bracket 500 showing the two alignment sticks being held in a perpendicular relationship.

Figure 2:
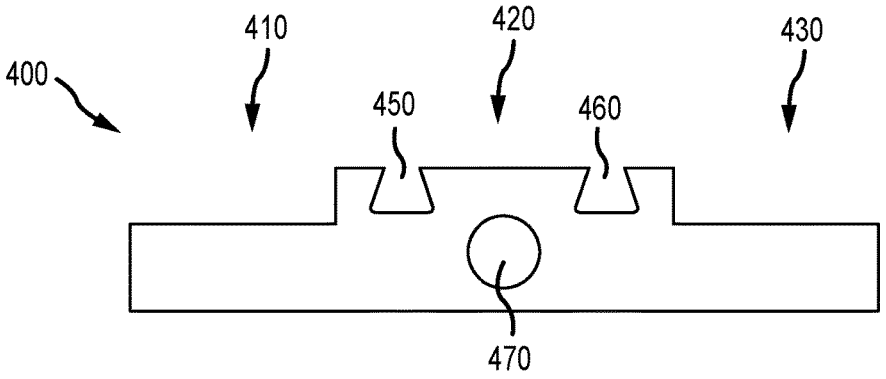
FIG. 2 is a side view of a first bracket of the golf alignment aid illustrated in FIG. 1 showing the first, second, and third channels.
Figure 3A:
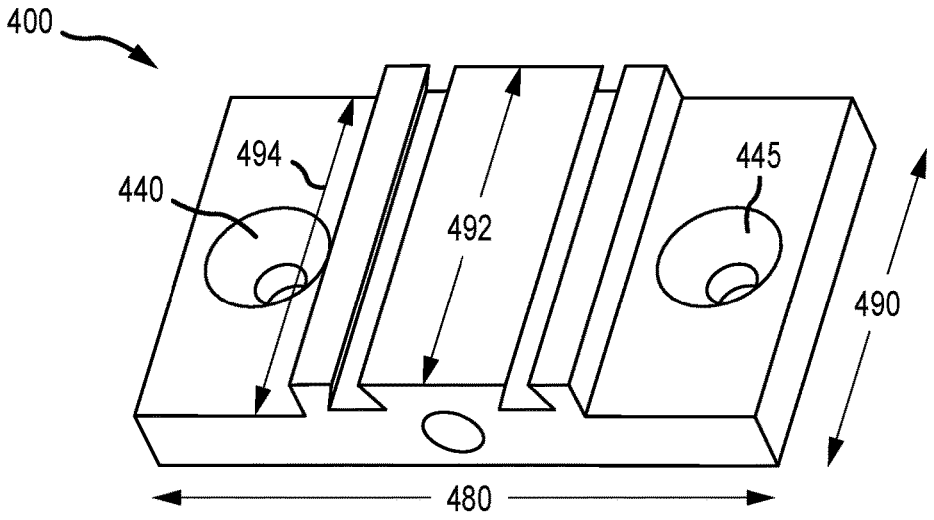
FIG. 3A is a top perspective view of the first bracket illustrated in FIG. 2.

Referring to FIG. 2 and FIG. 3A, the first bracket 400 includes a first portion 410, a second portion 420, and a third portion 430. The first portion 410 of the first bracket 400 has a first width 494. The second portion 420 of the first bracket 400 has a second width 492. The third portion 430 of the first bracket 400 has a third width 490. In the illustrated embodiment, the first width 494 of the first portion may be equal to the second width 492 of the second portion 420, and the first width 494 of the first portion 410 may be equal to the third width 490 of the third portion 430. In other embodiments, the width of each portion of the first bracket 400 may differ from the other portions. In still other embodiments, the first portion 410, second portion 420, and third portion 430 may have attachment points to allow the user to removably attach width extending members to extend the width of any or all portions. Adding width to the first or bottom bracket 400 may be desirable to increase the stability of overall practice aid.

Referring again to FIG. 2, FIG. 3A, and FIG. 3B, the first bracket 400 has a total length 480. The first portion 410 of the first bracket 400 has a first length 482. The second portion 420 of the first bracket 400 has a second length 484. The third portion 430 of the first bracket 400 has a third length 486. In the illustrated embodiment, the first length 482 of the first portion 410 may be equal to the second length 484 of the second portion 420, and the first length 482 of the first portion 410 may be equal to the third length 486 of the third portion 430. In other embodiments, the length of each portion of the first bracket 400 may differ from the other portions.

With reference to FIG. 3A, the first bracket 400 has a total length 480. The total length 480 may be larger than a width 490. The total length 480 may be smaller than a width 490. The total length 480 may be the same as a width 490. In other embodiments, the first bracket 400 may have attachment points to allow the user to extend the length of the first bracket by removably attaching length extending members to either end.

Figure 3B:
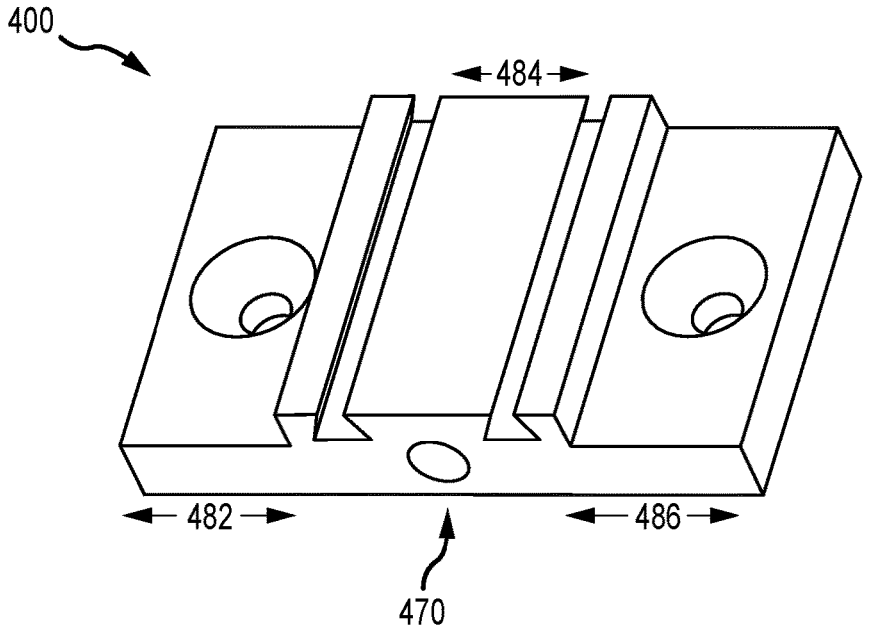
FIG. 3B is another top perspective view of the first bracket illustrated in FIG. 2.
Figure 3C:
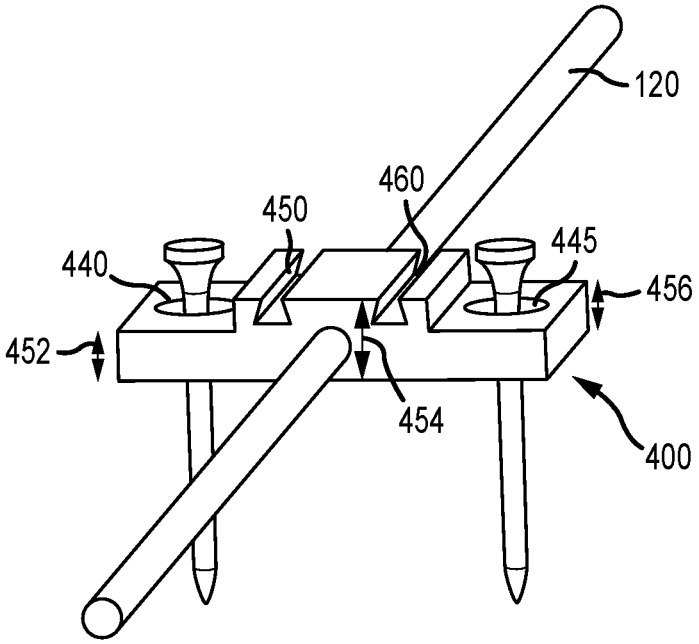
FIG. 3C is a side perspective view of the first bracket with a first alignment stick in place and showing golf tees used as securing pegs through the apertures provided.

With reference to FIGS. 3A, 3B and 3C, the first portion 410 may include a first aperture 440 configured to receive an attachment, such as a golf tee, to secure the first bracket 400 to the ground. The third portion 430 may include a second aperture 445 configured to receive an attachment, such as a golf tee, to secure the first bracket 400 to the ground. The first aperture 440 and the second aperture 445 may have a counter sink configured to receive a typical golf tee shape. The first bracket may have 4, 6, 8, 10 or more apertures.

In other embodiments, the first bracket 400 may not have any apertures configured to receive an attachment, such as a golf tee, to secure the first bracket 400 to the ground. Instead, the first bracket 400 may have a plurality of spikes or teeth protruding from the ground contact surface opposite the channels 450 and 460 to hold the first bracket 400 in place on a surface. In still another embodiment, the first bracket 400 may have Velcro® or some other releasable attachment mechanism to hold the first bracket 400 in place on a prepared receiving surface.

Again referring to FIG. 2 and FIG. 3B, which respectively show a side view and a top perspective view of the first bracket 400, the first bracket 400 has a third channel 470. The third channel 470 comprises a bore through the second width 492 of the second portion 420. The third channel 470 is configured to facilitate the placement of a first alignment stick 120 through the third channel 470 such that the first alignment stick 120 is held approximately perpendicular to the total length 480 of the first bracket 400 as illustrated in FIG. 1C.

The third channel 470 may be entirely contained within the second portion 420 of the first bracket 400, or it may have an opening toward the lower portion of the first bracket 400 opposite the first and second channels 450 and 460. The third channel 470 may have a generally circular cross sectional shape. The third channel 470 may have a generally elliptical cross sectional shape. The third channel 470 may have a generally polygonal cross sectional shape. The third channel 470 may have a cross shaped cross sectional shape. The third channel 470 may have any cross sectional shape. The third channel 470 has a cross sectional shape large enough accommodate sliding the first alignment stick 110 entirely through the third channel 470.

FIG. 3C illustrates the bottom bracket 400 with the alignment stick 120 in place and also showing a golf tee in the first aperture 440 and a golf tee in the second aperture 445. In other embodiments, the first portion 410 and the third portion 430 may have more than one aperture configured to receive an attachment, such as a golf tee, to secure the first bracket 400 to the ground. The first portion 410 may comprise a height of about 0.5 inch. The first portion 410 may comprise a height between 0.1 and 2.0 inches.

Referring to FIG. 2 and FIG. 3C, the second portion 420 is positioned between the first portion 410 and the third portion 430. The first portion 410 has a first height 452, the second portion 420 has a second height 454, and the third portion 430 has a third height 456. The second portion 420 may be raised relative to the first portion 410 and the third portion 430, and therefore may have a second height 454 greater than the first height 452 of the first portion 410 and the third height 456 of the third portion 430. The second portion 420 includes a second height 454 of about 1.0 inch. The second portion 420 may comprise a second height 454 between 0.25 and 3.0 inches.

With reference to FIG. 2, and FIGS. 3A-3C, the second portion 420 may include a first channel 450 having a generally triangular-shaped cross-section. The first channel 450 may extend the along the second width 492 of second portion 420 of the first bracket 400. The second portion 420 may also include a second channel 460, which may have a generally triangular-shaped cross-section. The second channel 460 may extend the second width 492 of the second portion 420 of the first bracket 400. The first channel 450 and the second channel 460 may each be configured to receive a complementary-shaped rail on the second bracket 500. As illustrated in FIG. 2, the cross-sectional shape of the first channel 450 and the second channel 460 is the same; however, in other embodiments the cross-sectional shape of the first channel 450 may be different than the cross-sectional shape of the second channel 460. In other constructions, the cross-sectional shape of the first channel 450 and the second channel 460 can be generally circular, ovular, square, pentagonal, hexagonal, or other suitable cross-sectional shapes.

In the embodiments illustrated in FIG. 2 and in FIGS. 3A-3C, the first channel 450 may be oriented parallel relative to the second channel 460. In the illustrated embodiment the center of the first channel 450 may be spaced about 1.0 inch from the center of the second channel 460. In other constructions, the center of the first channel 450 may be spaced about 0.5 inch to about 4.0 inches from the center of the second channel 460.

As illustrated in FIGS. 1A-1C, the illustrated embodiment of the claimed golf practice aid is comprised of two brackets. The first or bottom bracket 400 provides a fixed base upon which a second or top bracket 500 is slidably attached.

FIG. 5 shows a second bracket 500. The second bracket 500 comprises a first rail 510 and a second rail 520. The first rail 510 and the second rail 520 are configured to be approximately parallel to one another. The second bracket 500 comprises a plurality of cross bars 530. The plurality of cross bars 530 structurally connect the first rail 510 and the second rail 520. The plurality of cross bars 530 may be configured such that they are approximately perpendicular to the first rail 510 and the second rail 520. The second bracket 500 further comprises a cradle 540 configured to receive the second alignment stick 120. The cradle 540 may be further configured to have a first block 560 and a second block 570 on each of two sides.

Figure 4A:
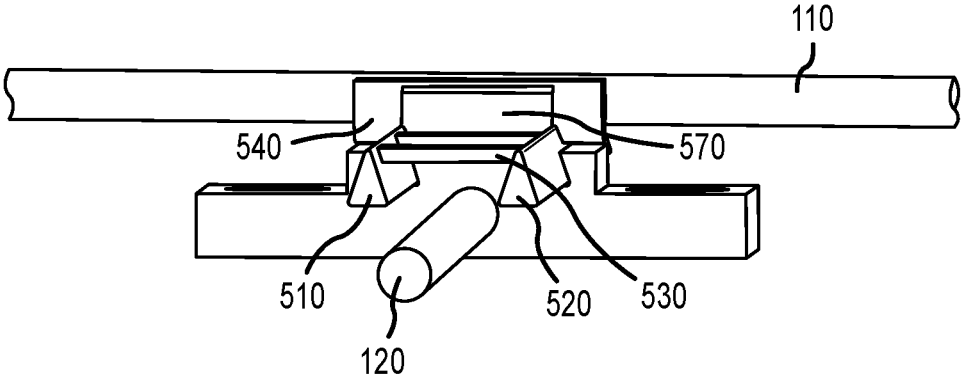
FIG. 4A is a side cut away perspective view of the golf alignment aid with alignment sticks in place.

With reference to FIG. 4A and FIG. 3C, the first rail 510 may be elongated and include a generally triangular-shaped cross-section configured to be received in the first channel 450 of the first bracket 400. The second rail 520 may be elongated and include a generally triangular-shaped cross-section configured to be received in the second channel 460 of the first bracket 400.

Referring to FIG. 5, the one or more cross bars 530 can be connected to the first rail 510 and the second rail 520, and provide reinforcement to the second bracket. The one or more cross bars 530 are configured such that they do not interfere when the first rail 510 and the second rail 520 are slidably received into the first channel 450 or second channel 460.

As illustrated in FIG. 4A, the cradle 540 is configured to receive a second alignment stick 110 and orient the second alignment stick 110 substantially perpendicular to the first alignment stick 120.

Figure 4B:
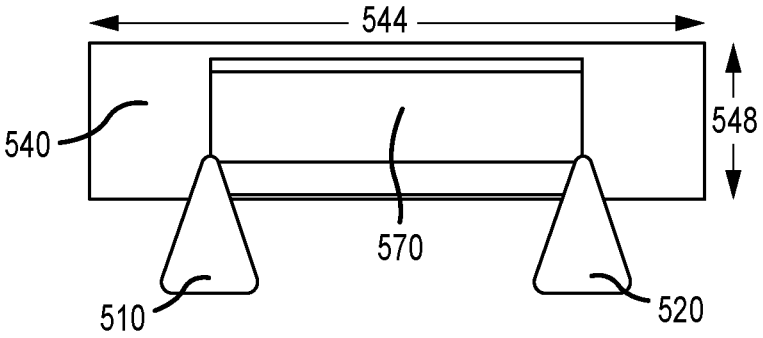
FIG. 4B is a side view of the center section of a second bracket.

Referring to FIG. 4B, the second bracket 500 may include a cradle 540, a first block 560, and a second block 570. The first block 560 and the second block 570 may be connected to the cradle 540. The second block 570 can be a rectangular block with a longitudinal axis parallel to the cradle 540. The second block 570 may be located on one long side of the cradle 540. The first block 560 can be a rectangular block with a longitudinal axis parallel to the cradle 540. The first block 560 may be located on another long side of the cradle 540 opposite the second block 570 as illustrated in FIG. 5. The first block 560 and the second block 570 may be connected to the first rail 510 and to the second rail 520.

Still referring to FIG. 4B, the cradle 540 has a length 544 and a height 548. Referring to FIG. 5, the cradle 540 may have a generally circular cross section configured with an upper opening along its longitudinal axis to receive an alignment stick with a generally circular cross section. The inner diameter of the cradle 540 may be larger than the outer diameter of the alignment stick. The cradle 540 may be made of a rigid material that does not deform when the alignment stick is placed in the cradle. The cradle 540 may be made of a material that is spread apart by the insertion of the alignment stick and which then retracts to hold the alignment stick in place. In another embodiment, the cradle 540 may be completely closed along its longitudinal axis providing only openings at each end which would allow the alignment stick to be slidably inserted into the cradle 540.

Again referring to FIG. 4B and FIG. 5, the cradle 540 may be generally semi-circular in cross-section. The cradle 540 may have a length of about 2.0 inches. The cradle 540 can have a length 544 of between 1.0 and 6.0 inches. The cradle 540 may have a width of approximately 0.5 inch. The cradle 540 can have a width of between 0.25 and 1.0 inch. The cradle 540 may have a height 548 of about 0.5 inch. The cradle 540 can have a height 548 of between 0.25 inch and 0.75 inch. The cradle 540 may have other cross section shapes such as generally elliptical, polygonal, or any appropriate shape to hold the alignment stick in place.

The first rail 510 and the second rail 520 have a generally triangular cross sectional shape configured to allow them to be slidably received into the first channel 450 and second channel 460. In other constructions, the cross-sectional shape of the first rail 510 and the second rail 520 can be generally circular, ovular, square, pentagonal, hexagonal, or other suitable cross-sectional shapes so long as their cross sectional shape allows them to be slidably received into the first channel 450 and second channel 460.

The first rail 510 and the second rail 520 are generally the same length. The rails may have lengths in the range between 2.0 inches and 30.0 inches. In other embodiments, each rail may have snap in or screw attachment points on the each end of the rail to allow additional sections to be added or removed to adjust the length of the rails.

Referring to FIG. 1B and FIG. 1C, the second bracket 500 is slidably inserted into the first bracket 400 such that the second bracket 500 slides within the first bracket 400 so that the second alignment stick 110 remains perpendicular to the first alignment stick 120, but indicates a different position upon which the golfer places a ball for the shot.

One skilled in the art will recognize that additional embodiments of the claimed invention are possible. The number of channels in the first bracket 400 can be 1 or 3 or more. The number of rails of the second bracket 500 would necessarily match the number channels in the first bracket 400. The various portions of the first bracket 400 and the second bracket 500 can be of a single, unitary construction, or they can be configured to be assembled together from other separate pieces.

The golf alignment aid 300 may be formed by injection molding with any suitable thermoplastic material. Some suitable thermoplastic materials are acrylic, ABS, nylon, PLA, polybenzimidazole, polycarbonate, polyether sulfone, polyetherether ketone, polyetherimide, polyethylene, polyenylene oxide, polyenylene sulfide, polyvinyl chloride, or Teflon™. Other thermoplastics may also be suitable. The golf alignment aid 300 may be formed by CNC milling blocks of thermoplastic or thermoset resins into the first bracket 400 and the second bracket 500. Some suitable thermoplastic materials are acrylic, ABS, nylon, PLA, polybenzimidazole, polycarbonate, polyether sulfone, polyetherether ketone, polyetherimide, polyethylene, polyenylene oxide, polyenylene sulfide, polyvinyl chloride, or Teflon™. Other thermoplastic materials may be suitable. Some suitable thermoset resins are epoxy resins, phenolic resins, and unsaturated polyester resins. Other thermoset resins may be suitable. The golf alignment aid 300 may be formed by CNC milling blocks of metals into the first bracket 400 and the second bracket 500. Some suitable metals are aluminum, magnesium, or titanium. Other metals may be suitable. The bracket system 300 may be formed by additive manufacturing methods such as extrusion deposition, laser consolidation of granular materials, or photopolymerization. Suitable materials for the additive manufacturing of the golf alignment aid 300 may comprise ABS, PLA, UV-cured resins, nylon, powdered metals, or powdered ceramics. Portions of the golf alignment aid 300 may be made of different materials and by different methods.

The first bracket 400 and the second bracket 500 may have designated locations provided on surfaces, visible to the player while in use, to allow logos, other decorative art, or instructive designations to be either removably or permanently affixed.

Figure 6:
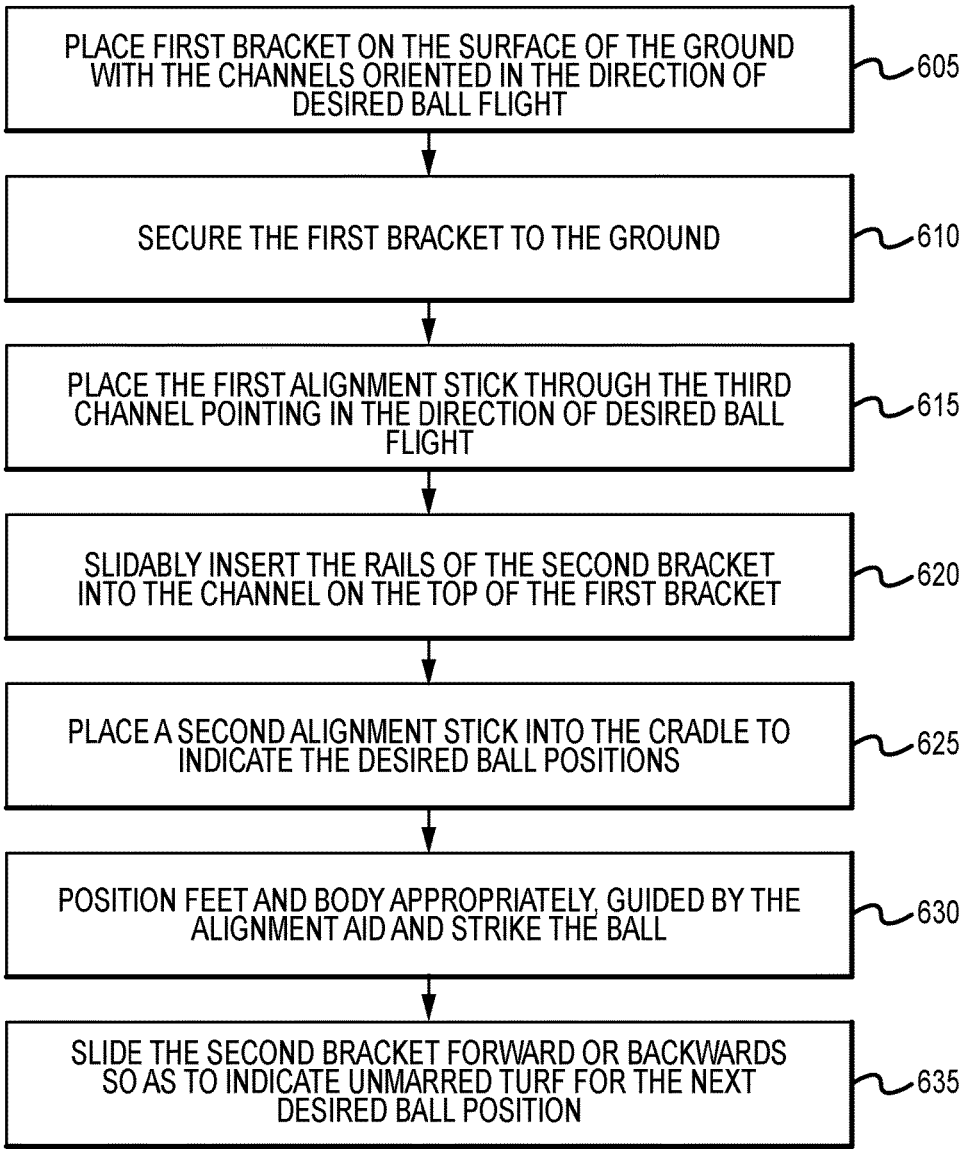
FIG. 6 illustrates a method of using the golf alignment aid.

FIG. 6 illustrates a flow chart of a method of using the golf alignment aid 300. A golfer places and secures (at 605) the first bracket 400 on the surface of the ground or other practice facility surface. The channels 450 and 460 of the first bracket 400 are oriented to be parallel to the desired direction of the ball flight when the golfer practices hitting the ball. In one embodiment the user may secure the first bracket 400 to the surface by pushing pins such as golf tees through the apertures 440 and 445 provided in the first bracket 400 (at 610). In another embodiment, the user may secure the first bracket 400 to the ground by pushing spikes (not illustrated) on the bottom of the first bracket 400 into the surface. In a third embodiment (not illustrated), the user may secure the first bracket 400 to the surface by means of a releasable attachment mechanism such as Velcro™. The user positions (at 615) alignment stick 110 into the third channel 470 of the first bracket 400 aligned with the desired direction of ball flight. The user slidably inserts (at 620) the rails 510 and 520 of the second bracket 500 into the complementary channels 450 and 460 of the first bracket 400. The user may then position (at 625) alignment stick 120 in the cradle 540 of the second bracket 500 adjusting alignment stick 120 to point to the desired position of the first ball placement for the first shot. The user may then strike the ball (at 630). For subsequent shots the user moves the second bracket 500 either forwards or backwards (at 635) by pushing on the rectangular block 560 or 570 with either their hand or a golf club to cause alignment stick 120 to point to un-marred ground for the ball position for each subsequent shot.

The golf alignment aid 300 may have other methods of use in other embodiments and under other playing conditions.

Clause 1: A golf alignment aid comprising: a first bracket including a first portion, a second portion adjacent to the first portion, and a third portion adjacent to the second portion;

the second portion including a first channel and a second channel oriented parallel with the first channel, and a third channel configured to receive a first alignment stick, and a second bracket including a first rail slidably received within the first channel, a second rail oriented parallel with the first rail and slidably received within the second channel, and a cradle positioned between the first rail and the second rail; the cradle configured to receive a second alignment stick oriented perpendicular to the first alignment stick.

Clause 2: The golf alignment aid of clause 1 wherein the first channel has a first cross sectional area, the second channel has a second cross sectional area, and the first cross sectional area of the first channel is the same as the second cross sectional area of the second channel.

Clause 3: The golf alignment aid of clause 1, wherein the first portion of the first bracket has a first width, the second portion of the first bracket has a second width, the third portion of the first bracket has a third width, and further wherein the first width, the second width, and the third width are equal.

Clause 4: The golf alignment aid of clause 1, wherein the first portion of the first bracket has a first width, the second portion of the first bracket has a second width, the third portion of the first bracket has a third width, and further wherein the second width is greater than the first width of the first portion of the first bracket and is greater than the third width of the third portion of the first bracket.

Clause 5: The golf alignment aid of clause 1, wherein the first rail includes a first length and the second rail includes a second length, and further_wherein the first length and the second length are equal.

Clause 6: The golf alignment aid of clause 1, wherein: the cradle is semi-circular in cross-sectional area.

Clause 7: The golf alignment aid of clause 1, wherein the cradle defines a longitudinal axis, and further wherein the longitudinal axis is oriented perpendicular to the first rail.

Clause 8: The golf alignment aid of clause 7, wherein the longitudinal axis of the cradle is oriented perpendicular to the second rail.

Clause 9: The golf alignment aid of clause 7, further comprising a first club contact block connected to a first side of the cradle and having a longitudinal axis parallel to the longitudinal axis of the cradle; and a second club contact block connected to a second side of the cradle opposite the first club contact block and defines a longitudinal axis parallel to the longitudinal axis of the cradle.

Clause 10: The golf alignment aid of clause 1, wherein the first bracket is configured to be secured to the ground.

Clause 11: The golf alignment aid of clause 10, wherein the first portion of the first bracket includes a first aperture, the third portion of the first bracket includes a second aperture, and further wherein the first aperture and the second aperture are configured to receive a pin configured to penetrate a ground surface to secure the first bracket in position during use.

Clause 12: The golf alignment aid of clause 10, wherein the first bracket includes at least two spikes on a bottom surface that are configured to penetrate a ground surface to secure the first bracket in position during use.

Clause 13: A method for using a golf alignment aid; the method comprising: a) placing the golf alignment aid of clause 1 on a surface of a ground, b) orienting the first bracket of the golf alignment aid with the channels in the direction of the desired ball flight, c) placing the first alignment stick through the third channel oriented in the direction of the desired ball flight, d) slidably inserting the rails of the second bracket into the channels of the second portion of the first bracket, e) placing the second alignment stick in the cradle to indicate the desired ball position, f) sliding the second bracket forward or backwards so as to cause the second alignment stick to indicate un-marred surface for the next desired ball position.

Clause 14: The method of clause 13; wherein the first bracket is secured to the surface after placing the first bracket on the surface and orienting the first bracket with channels in the direction of the desired ball flight.

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

While the above examples may be described in connection with a driver-type golf club, the apparatus, methods, and articles of manufacture described herein may be applicable to other types of golf club such as a fairway wood-type golf club, a hybrid-type golf club, an iron-type golf club, a wedge-type golf club, or a putter-type golf club.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

Various features and advantages of the disclosure are set forth in the following claims.

What is claimed is:

1. A golf alignment aid comprising:

a first bracket including
- a first portion,
- a second portion adjacent to the first portion, and
- a third portion adjacent to the second portion, the second portion including
  - a first channel and a second channel oriented parallel with the first channel, and
  - a third channel configured to receive a first alignment stick; and a second bracket including
- a first rail slidably received within the first channel,
- a second rail oriented parallel with the first rail and slidably received within the second channel, and a cradle positioned between the first rail and the second rail,
- the cradle configured to receive a second alignment stick oriented perpendicular to the first alignment stick.

2. The golf alignment aid of claim 1, wherein
the first channel has a first cross sectional area, the second channel has a second cross sectional area, and the first cross sectional area of the first channel is the same as the second cross sectional area of the second channel.

3. The golf alignment aid of claim 1, wherein
the first portion of the first bracket has a first width, the second portion of the first bracket has a second width, the third portion of the first bracket has a third width and further wherein
the first width, the second width, and the third width are equal.

4. The golf alignment aid of claim 1, wherein
the first portion of the first bracket has a first width, the second portion of the first bracket has a second width, the third portion of the first bracket has a third width, and further wherein the second width is greater than the first width of the first portion of the first bracket and is greater than the third width of the third portion of the first bracket.

5. The golf alignment aid of claim 1, wherein
the first rail includes a first length and the second rail includes a second length, and
further wherein the first length and the second length are equal.

6. The golf alignment aid of claim 1, wherein
the cradle is semi-circular in cross-sectional area.

7. The golf alignment aid of claim 1, wherein
the cradle defines a longitudinal axis,
and further wherein
the longitudinal axis is oriented perpendicular to the first rail.

8. The golf alignment aid of claim 7, wherein
the longitudinal axis of the cradle is oriented perpendicular to the second rail.

9. The golf alignment aid of claim 7, further comprising:
a first club contact block which is connected to a first side of the cradle and having a longitudinal axis parallel to the longitudinal axis of the cradle; and
a second club contact block which is connected to a second side of the cradle opposite the first club contact block and defines a longitudinal axis parallel to the longitudinal axis of the cradle.

10. The golf alignment aid of claim 1, wherein the first bracket is configured to be secured to the ground.

11. The golf alignment aid of claim 10, wherein
the first portion of the first bracket includes a first aperture, the third portion of the first bracket includes a second aperture,
and further wherein
the first aperture and the second aperture are configured to receive a pin configured to penetrate a ground surface to secure the first bracket in position during use.

12. The golf alignment aid of claim 10, wherein
the first bracket includes at least two spikes on a bottom surface that are configured to penetrate a ground surface to secure the first bracket in position during use.

13. A method for using a golf alignment aid; the method comprising:
a) placing the golf alignment aid of claim 1 on a surface of a ground;
b) orienting the first bracket of the golf alignment aid with the channels in the direction of the desired ball flight;
c) placing the first alignment stick through the third channel oriented in the direction of the desired ball flight;
d) slidably inserting the rails of the second bracket into the channels of the second portion of the first bracket;
e) placing the second alignment stick in the cradle to indicate the desired ball position; and
f) sliding the second bracket forward or backwards so as to cause the second alignment stick to indicate unmarred surface for the next desired ball position.

14. The method of claim 13, wherein the first bracket is secured to the surface after placing the first bracket on the surface and orienting the first bracket with channels in the direction of the desired ball flight.

* * * * *